US009290920B2

(12) United States Patent
Willburn et al.

(10) Patent No.: US 9,290,920 B2
(45) Date of Patent: Mar. 22, 2016

(54) TOILET VENT SYSTEM

(71) Applicant: Randy White, Dalhart, TX (US)

(72) Inventors: Eddie Willburn, Amarillo, TX (US); Roger D. Hayes, Amarillo, TX (US)

(73) Assignee: Throne Cyclone, LLC, Dalhart, TX (US)

( * ) Notice: Subject to any disclaimer, the term of this patent is extended or adjusted under 35 U.S.C. 154(b) by 0 days.

(21) Appl. No.: 14/367,915

(22) PCT Filed: Dec. 21, 2012

(86) PCT No.: PCT/US2012/071527

§ 371 (c)(1),
(2) Date: Jun. 21, 2014

(87) PCT Pub. No.: WO2013/096930

PCT Pub. Date: Jun. 27, 2013

(65) Prior Publication Data

US 2014/0338112 A1 Nov. 20, 2014

(51) Int. Cl.
*E03D 9/04* (2006.01)
*E03D 9/052* (2006.01)

(52) U.S. Cl.
CPC *E03D 9/04* (2013.01); *E03D 9/052* (2013.01); *Y10T 29/49826* (2015.01)

(58) Field of Classification Search
CPC ..... E03D 9/052
USPC ..... 4/211, 216–217, 347–353, 369, 209 R, 4/213, 370–371
See application file for complete search history.

(56) References Cited

U.S. PATENT DOCUMENTS

| | | | |
|---|---|---|---|
| 3,122,757 | A | 3/1964 | Sowards |
| 5,991,933 | A | 11/1999 | Schaffer |
| 7,162,751 | B2 | 1/2007 | Mundt |
| 2005/0155140 | A1 | 7/2005 | Zulu |

*Primary Examiner* — Lori Baker
(74) *Attorney, Agent, or Firm* — Shannon L Warren

(57) ABSTRACT

A toilet vent comprising a first fluid connection and a second fluid connection. Said first fluid connection is between an upper portion of a tank of a toilet above a sanitary fluid level and a gas outlet outside of said tank. Said second fluid connection is between a supply line outside of said tank and one or more tank components inside of said tank. Said toilet vent is capable of housing said first fluid connection and said second fluid connection. A portion of said toilet vent, containing a portion of both said first fluid connection and said second fluid connection, passes through a fluid input in a bottom of said tank.

28 Claims, 15 Drawing Sheets

TOILET VENT SYSTEM

CROSS-REFERENCE TO RELATED APPLICATIONS

This application is the national phase filing of PCT application PCT/US2012/071527, filed Dec. 21, 2012.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

This disclosure relates generally to a toilet vent system and method. In one embodiment, this disclosure relates to said toilet vent system and method.

Various methods of ventilating a toilet and/or a room containing a toilet have been tried and are well-known.

In one embodiment, a ventilation system is installed in a ceiling of a room containing said toilet. This approach leaves much to be desired, however. For example, when odorous gases accumulate in a bowl of said toilet, they have no place to go but into the presence of a user of said toilet.

In one embodiment, a fan system is installed in a tank of said toilet. This approach demonstrates that odorous gases do, indeed, make their way from said bowl into said tank of said toilet. However, this embodiment presents various problems. Namely, how to properly clean said odorous gases within said tank of said toilet. Even modern air filters are no match for many of the odorous gases captured in said tank. Further, in several embodiments, said ventilation systems, kept in said tank with water, run on electricity. Accordingly, a risk of electrical shock and personal harm is risked by using said systems.

None of the above inventions and patents, taken either singularly or in combination, is seen to describe the instant disclosure as claimed. Accordingly, an improved toilet vent system and method would be advantageous.

BRIEF SUMMARY OF THE INVENTION

A toilet vent system and method are disclosed. Said toilet vent system comprising a toilet vent. Said toilet vent comprising a first fluid connection and a second fluid connection. Said first fluid connection is between an upper portion of a tank of a toilet above a sanitary fluid level and a gas outlet outside of said tank. Said second fluid connection is between a supply line outside of said tank and one or more tank components inside of said tank. Said toilet vent is capable of housing said first fluid connection and said second fluid connection. A portion of said toilet vent, containing a portion of both said first fluid connection and said second fluid connection, passes through a fluid input in a bottom of said tank.

Said toilet vent method comprising installing a toilet vent having a first fluid connection and a second fluid connection into a tank of a toilet through a fluid input of said tank; connecting an upper portion of said tank to a gas outlet through said first fluid connection; connecting a supply line containing a sanitary fluid to one or more tank components in said tank. Said upper portion comprises an interior portion of tank above a fluid level of said sanitary fluid collected in said tank.

DETAILED DESCRIPTION OF THE INVENTION

Described herein is a toilet vent system and method. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
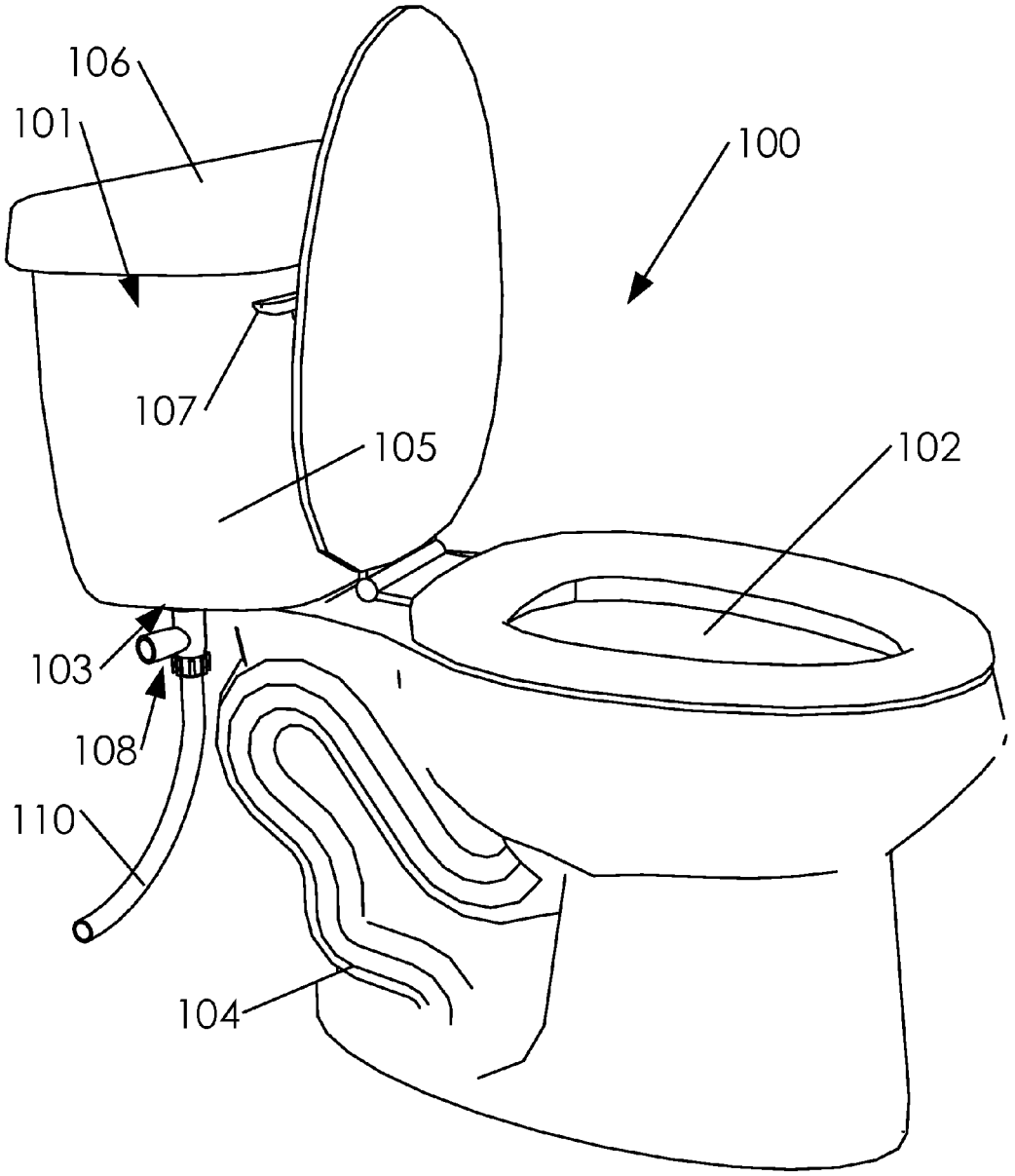
FIG. 1 illustrates a toilet.

FIG. 1 illustrates a toilet 100. Toilet 100 can comprise a tank 101, a bowl 102, a fluid input 103, and a waste output 104. In one embodiment, tank 101 can comprise a base portion 105, a lid 106 and a flush handle 107. In one embodiment, said toilet vent system and method can comprise a toilet vent 108. Only a portion of toilet vent 108 is visible in FIG. 1. In one embodiment, base portion 105 can store a sanitary fluid 109 (not shown). In one embodiment, base portion 105 can receive sanitary fluid 109 through a supply line 110. In one embodiment, sanitary fluid 109 can comprise water. In one embodiment, sanitary fluid 109 can comprise water and other chemicals as are common in the art. In one embodiment, supply line 110 can attach to a portion of toilet vent 108 at one end and to a stop valve assembly at another end; wherein, said stop valve assembly is capable of supplying sanitary fluid 109 to supply line 110. In one embodiment, lid 106 can fit and cover said base portion 105. In one embodiment, base portion 105 can comprise a fluid input 103 for receiving sanitary fluid 109.

In one embodiment, toilet vent 108 can function on a range of well-known and preinstalled types of said toilet 100. The functionality of toilet 100 is well known but subject to change with various improvements. Nonetheless, toilet vent 108 is designed to work with a changing state of the art for toilet 100, as will be discussed infra. For purposes of this disclosure, functionality toilet 100 has been simplified to support an adequate discussion of toilet vent 108. Thus, it is sufficient to state that in one embodiment toilet 100 handles waist in a fluid process comprising: receiving sanitary fluid 109 through fluid input 103; storing sanitary fluid 109 in tank 101; storing an initial supply of sanitary fluid 109 in bowl 102; receiving said waist in bowl 102; releasing sanitary fluid 109 into bowl 102 upon triggering flush handle 107; and flushing said waist and a portion of sanitary fluid 109 down waste output 104.

Figure 2A:
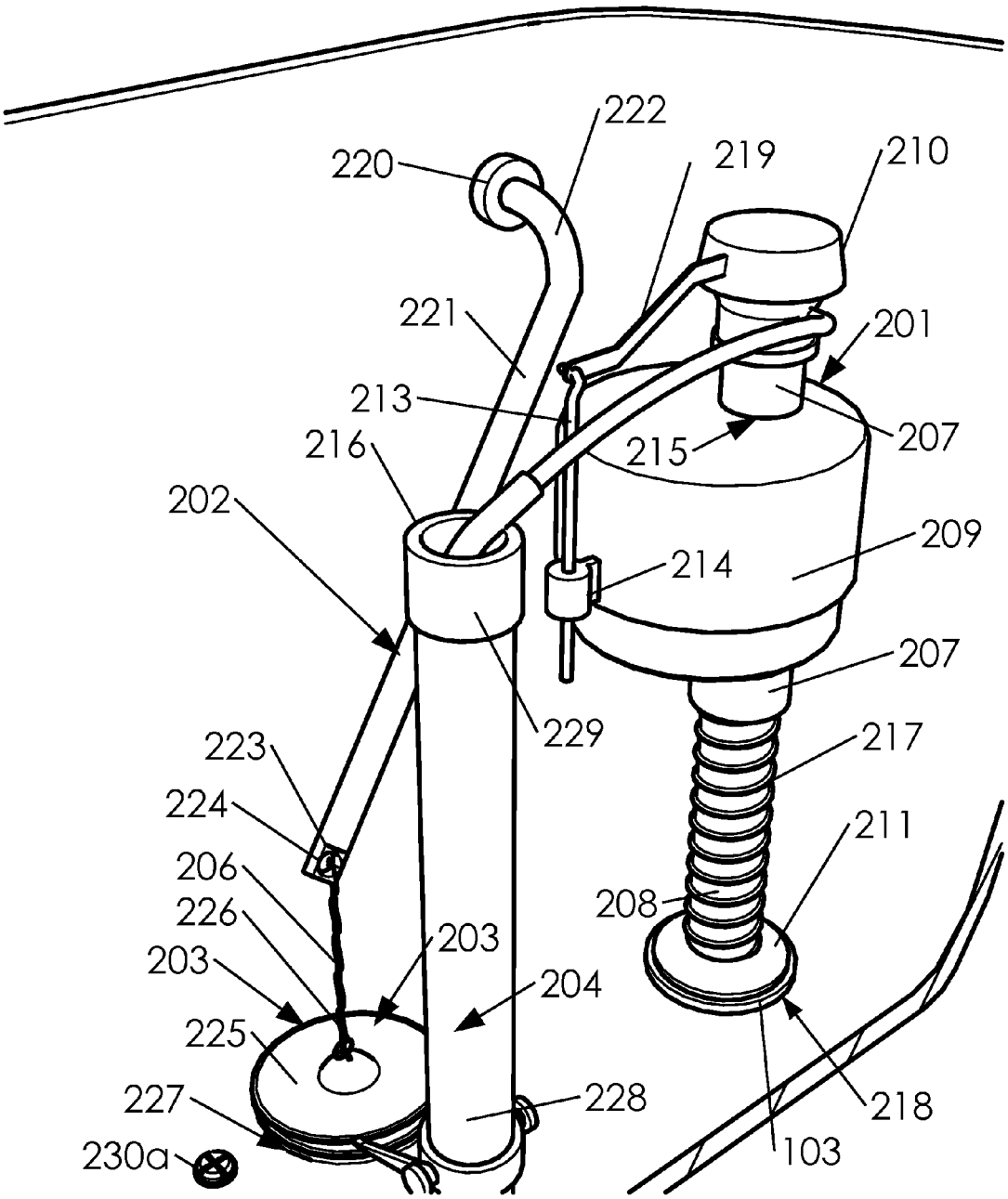
FIGS. 2A, 2B and 2C illustrate a front perspective view, a top elevated view and a rear elevated view of a plurality of tank components in a prior art configuration of toilet.
Figure 2B:
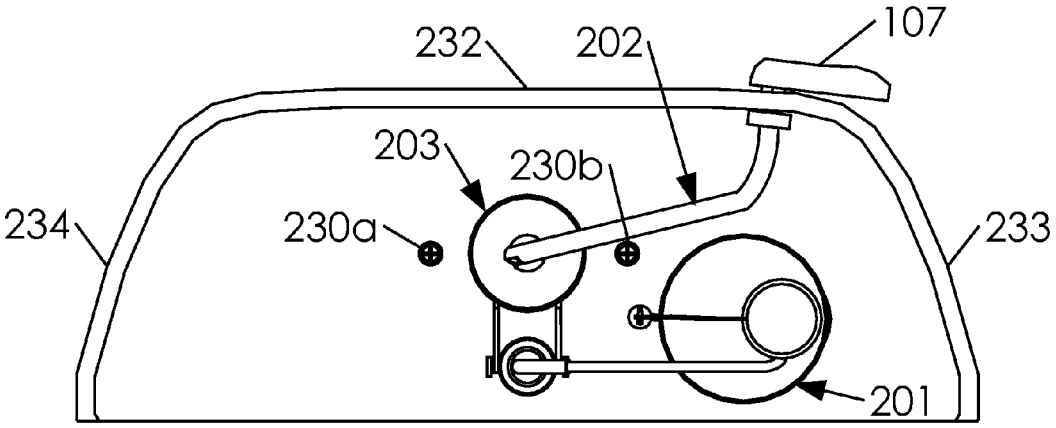
Figure 2C:
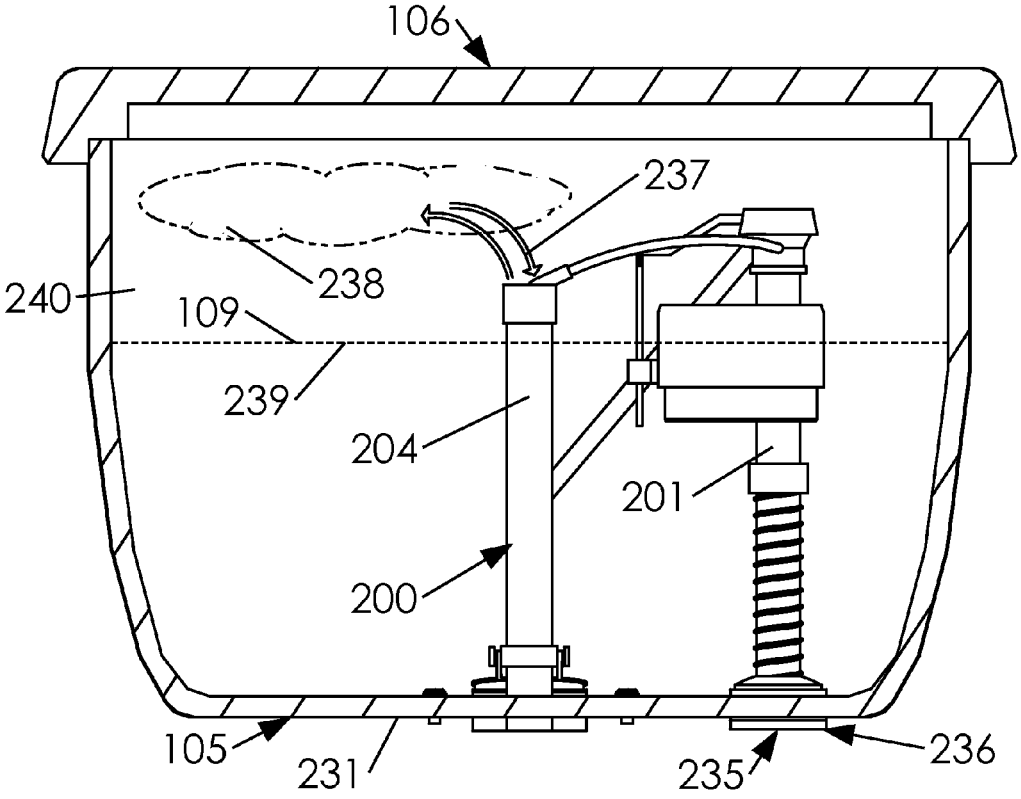

FIGS. 2A, 2B and 2C illustrate a front perspective view, a top elevated view and a rear elevated view of a plurality of tank components 200 in a prior art configuration of toilet 100. In one embodiment, said prior art configuration of toilet 100 does not comprise toilet vent 108. A discussion of tank components 200 in said prior art configuration of toilet 100 is disclosed to support an understanding of toilet vent 108, but it will become clear, supra, that toilet vent 108 can be used with yet unknown and other not described variations of tank components 200.

In one embodiment, tank components 200 can comprise a ballcock assembly 201, a handle assembly 202, a flapper assembly 203, an overflow tube 204, a flush valve 205, and a chain 206. In one embodiment, ballcock assembly 201 can comprise a valve body 207, an adjustable length stem 208, a float 209, a cap 210, a coupling 211, an arm 212, a guide 213, and a clip 214. In one embodiment, float 209 can comprise a body aperture 215 capable of receiving valve body 207. In one embodiment, float 209 can move substantially vertically up and down on valve body 207. In one embodiment, adjustable length stem 208 can move into and out of valve body 207. In one embodiment, adjustable length stem 208 can comprise a thread 217 to assist in moving and holding adjustable length stem 208 within valve body 207. In one embodiment, adjustable length stem 208 can comprise coupling 211 at one end and valve body 207 at an opposite end. In one embodiment, valve body 207 can comprise adjustable length stem 208 at one end and cap 210 at an opposite end. In one embodiment, adjustable length stem 208 and valve body 207 can comprise a round cross-section and a substantially cylindrical shape.

In one embodiment, sanitary fluid 109 can flow into tank 101 through fluid input 103, into ballcock assembly 201 through coupling 211, through adjustable length stem 208, through valve body 207 and, finally, arrive at cap 210. In one embodiment, sanitary fluid 109 can flow out from cap 210 and into tank 101. In one embodiment, cap 210 can comprise a refill tube 216 for carrying a portion of sanitary fluid 109 from ballcock assembly 201 to overflow tube 204. In one embodiment, a gasket 218 can seal ballcock assembly 201 against fluid input 103. In one embodiment, float 209 can comprise clip 214 capable of adjusting a water level at which float 209 rests. In one embodiment, clip 214 can slide through guide 213, guide 213 can attach to a guide arm 219, and guide arm 219 can rotatably attach cap 210, as is common in the art. In one embodiment, guide arm 219 can comprise a resting position and an active position; wherein, said resting position can comprise guide arm 219 in rotated upward and preventing sanitary fluid 109 from flowing into tank 101, and said active position can comprise guide arm 219 rotated downward and allowing sanitary fluid 109 to flow into tank 101.

Handle assembly 202 can comprise flush handle 107, a hinge assembly 220 and a flapper lifter 221. In one embodiment, flush handle 107 can attach to one side of hinge assembly 220 and flapper lifter 221 can attach to another side of hinge assembly 220. In one embodiment, hinge assembly 220 can be inserted through and pivot upon an aperture in tank 101, as is well known in the art. In one embodiment, handle assembly 202 can comprise a first end 222 and a second end 223. In one embodiment, second end 223 can comprise an eye 224. In one embodiment, chain 206 can attach to eye 224 at one end and flapper assembly 203 at another end. In one embodiment, pressing flush handle 107 can cause flapper lifter 221 to pivot up and life eye 224, chain 206 and a portion of said flapper assembly 203, as is known in the art.

In one embodiment, flapper assembly 203 can comprise a flapper 225 and a flapper hinge assembly 226. In one embodiment, pulling chain 206 upward will cause flapper 225 to rock upward on flapper hinge assembly 226, and allow sanitary fluid 109 in tank 101 to drain into bowl 102. In one embodiment, bowl 102 can be in fluid connection with tank 101 through a flush valve seat 227 under flapper 225 and through overflow tube 204.

In one embodiment, overflow tube 204 can comprise a lower end 228 and an upper end 229. In one embodiment, tank 101 can attach to toilet 100 with a first bolt 230*a* and a second bolt 230*b*. In one embodiment, tank 101 can comprise a bottom 231, a front 232, a first side 233 and a second side 234. In one embodiment, ballcock assembly 201 can further comprise a threaded tip 235 attached through fluid input 103 to female threaded socket. In one embodiment, a second gasket 236 can be used outside of base portion 105 between threaded tip 235 and said female threaded socket.

In one embodiment, a fluid connection 237 can transfer a portion of sanitary fluid 109 and gases 238 between tank 101 and bowl 102. In one embodiment, fluid connection 237 can comprise one or more entry points in tank 101 such as overflow tube 204 and flapper assembly 203. In one embodiment, sanitary fluid 109 can comprise a sanitary fluid level 239 comprising a top surface of sanitary fluid 109 in tank 101. In one embodiment, tank 101 can comprise an upper portion 240 comprising a portion of tank 101 above sanitary fluid level 239. In one embodiment, gases 238 can collect in upper portion 240.

In one embodiment, a portion of gases 238 can flow between tank 101 and bowl 102 through overflow tube 204. Likewise, in one embodiment, sanitary fluid 109 can flow into bowl 102 from tank 101 when flapper 225 is lifted, thereby allowing said sanitary fluid 109 to drain through flush valve seat 227 and overflow tube 204. In one embodiment, gases 238 can be returned to bowl 102 through overflow tube 204 and flush valve seat 227. Likewise, in one embodiment, sanitary fluid 109 can be delivered to tank 101 through overflow tube 204.

A problem arises in said prior art when gases 238 bear a foul odor which become trapped in tank 101. Said foul odor has traditionally been returned to bowl 102 when toilet 100 is flushed.

Figures 3A, 3B:
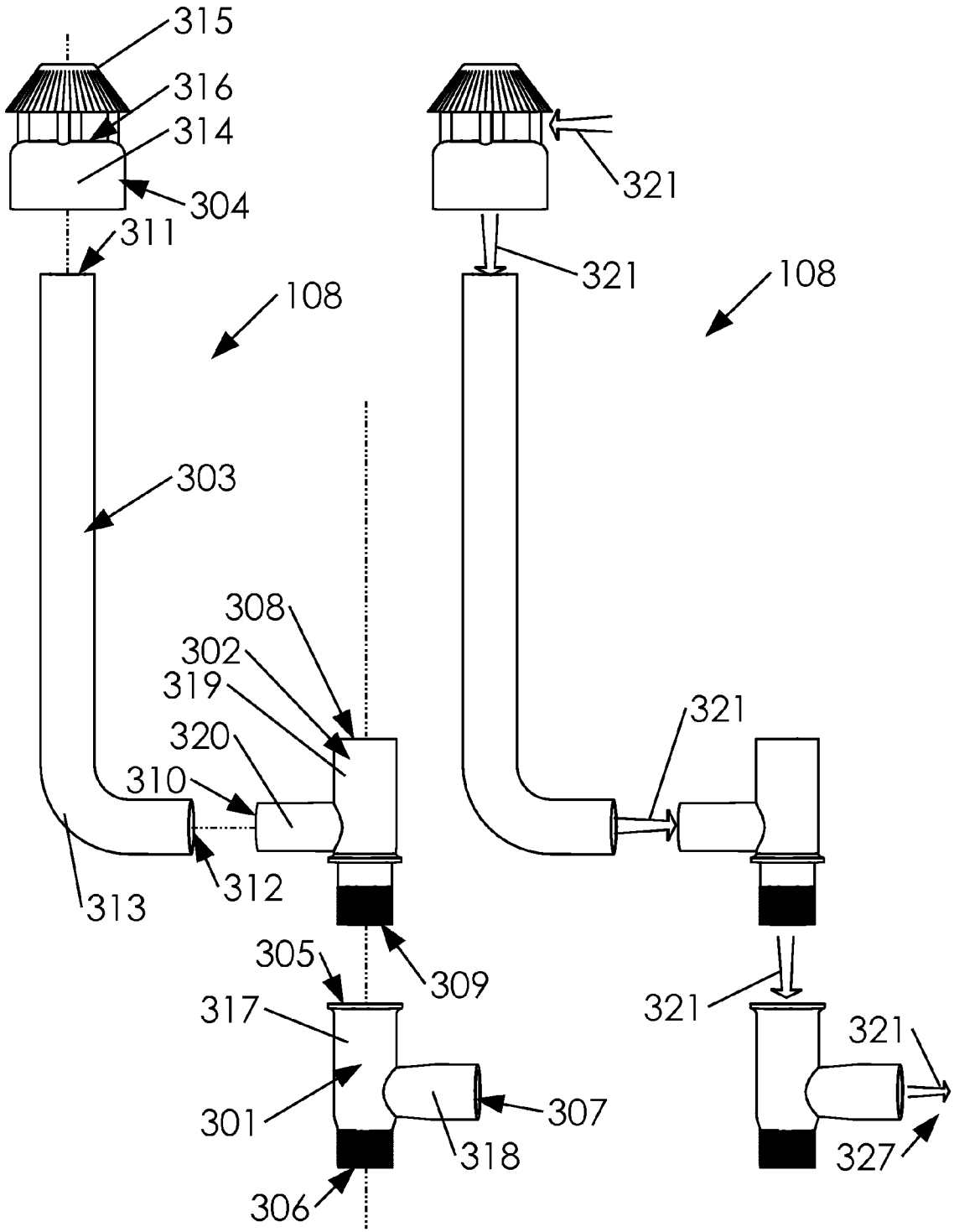
FIGS. 3A and 3B illustrate three elevated side views of a toilet vent broken apart.

FIGS. 3A and 3B illustrate three elevated side views of a toilet vent 108 broken apart. Toilet vent 108 can comprise a first manifold 301, a second manifold 302, a snorkel 303, and a floating vent 304. In one embodiment, first manifold 301 and second manifold 302 can each comprise a fluid passage comprising a plurality of openings for receiving or distributing a fluid or gas. First manifold 301 can comprise a fluid passage between a first opening 305, a second opening 306, and a third opening 307. Second manifold 302 can comprise a fluid passage between a first opening 308, a second opening 309 and a third opening 310. Snorkel 303 can comprise a fluid passage between a first opening 311 and a second opening 312. In one embodiment, snorkel 303 can comprise an elbow 313 between first opening 311 and second opening 312. Floating vent 304 can comprise a lower portion 314, an upper portion 315, and a vent 316. First manifold 301 can comprise a vertical portion 317 and a side portion 318. In one embodiment, second manifold 302 can comprise a vertical portion 319 and a side portion 320.

In one embodiment, a first fluid connection 321 (see FIG. 3B) can be created between first manifold 301, second manifold 302, snorkel 303, and floating vent 304. In one embodiment, first fluid connection 321 can comprise a fluid passage between vent 316 and third opening 307. For example, in one embodiment, gases 238 can pass from upper portion 240 through vent 316, through first opening 311, through snorkel 303, through second opening 312 into third opening 310, through second manifold 302 to second opening 309, through second opening 309, through first opening 305, through first manifold 301 to third opening 307, and out of third opening 307. Thus, in one embodiment, toilet vent 108 can comprise a means for expelling said gases 238 from tank 101 by means other than overflow tube 204 or flapper assembly 203, which funnel gases 238 back into bowl 102.

In one embodiment, first manifold 301 and second manifold 302 can each comprise a "T" shape; wherein, said "T" shape is rotated ninety degrees such that vertical portion 317 and vertical portion 319 comprise a top portion of said "T" shape oriented in a vertical direction; and side portion 318 and side portion 320 extend horizontally from a midpoint of vertical portion 317 and side portion 318, respectively. In one embodiment, vertical portion 317 can comprise a round cross-section between second opening 306 and first opening 305. Likewise, vertical portion 319 can comprise a round cross-section between first opening 308 and second opening 309. In one embodiment, side portion 318 can comprise a round cross-section substantially perpendicular to vertical portion 317. In one embodiment, side portion 320 can comprise a round cross-section perpendicular to vertical portion 318.

Figure 3C:
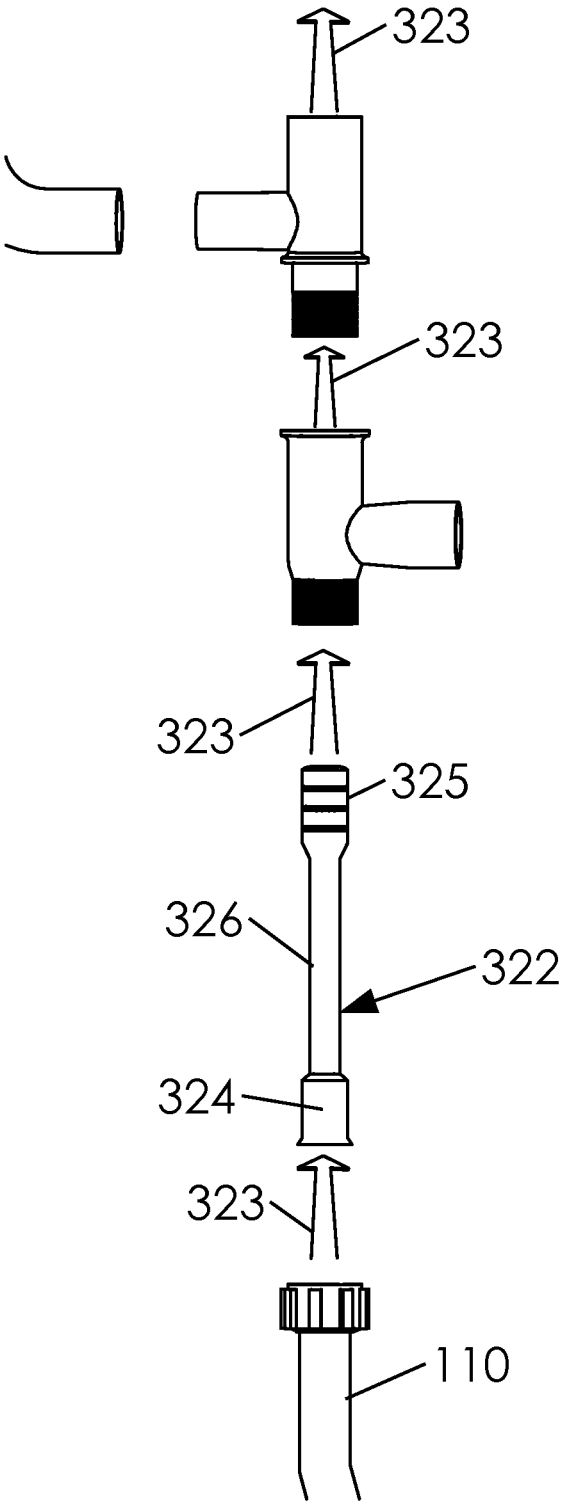
FIG. 3C illustrates an elevated side view of toilet vent 108 having an up rod.

FIG. 3C illustrates an elevated side view of toilet vent 108 having an up rod 322. In one embodiment, toilet vent 108 can comprise up rod 322. In one embodiment, toilet vent 108 can comprise a second fluid connection 323. In one embodiment, second fluid connection 323 can transport said sanitary fluid 109 from supply line 110 into ballcock assembly 201. In one embodiment, up rod 322 can comprise a first end 324, a second end 325 and a middle portion 326. In one embodiment, second fluid connection 323 can comprise a passage from supply line 110, through up rod 322, and into ballcock assembly 201.

In one embodiment, up rod 322 can comprise a substantially round cross-section. In one embodiment, up rod 322 can be inserted through first manifold 301 and second manifold 302.

In one embodiment, first fluid connection 321 can provide a passage from upper portion 240 to a gas outlet 327. In one embodiment, gas outlet 327 can comprise third opening 307. In one embodiment, gas outlet 327 can comprise a ventilation system. In one embodiment, said ventilation system can comprise one of a range of different bathroom ventilation systems well-known in the art.

FIGS. 4A, 4B, 4C, 4D and 4E illustrate a perspective front view, a perspective front section cut view, an elevated top view, an elevated front view, and an elevated bottom view of floating vent 304, respectively. In one embodiment, lower portion 314 and upper portion 315 can be connected by a plurality of separators 401. Separators 401 can comprise a separator 401*a*, a separator 401*b*, a separator 401*c* and a separator 401*d*. In one embodiment, separators 401 can provide a vent opening 402 between upper portion 315 and lower portion 314. In one embodiment, upper portion 315 can comprise an inverted cup shape having an open bottom end 403 and a closed top end 404 with a side wall 405. In one embodiment, closed top end 404 and side wall 405 can comprise a substantially round horizontal cross-section. In one embodiment, side wall 405 can taper inward from open bottom end 403 to closed top end 404. In one embodiment, side wall 405 can comprise a plurality of grooves 406 on an external surface of upper portion 315. In one embodiment, grooves 406 can comprise a means of bleeding off sanitary fluid 109 from on top of floating vent 304. In one embodiment, grooves 406 can comprise rounded slots in side wall 405 extending from closed top end 404 to open bottom end 403 on an external surface of upper portion 315.

In one embodiment, vent 316 can receive a portion of snorkel 303 by sliding first opening 311 through vent 316, and allowing first opening 311 to press against closed top end 404. Thus, in one embodiment, closed top end 404 can substantially block first opening 311 when pressing against first opening 311. Likewise, in one embodiment, upper portion 315 can permit first fluid connection 321 to flow through first opening 311 when closed top end 404 is lifted above first opening 311.

Figure 4A:
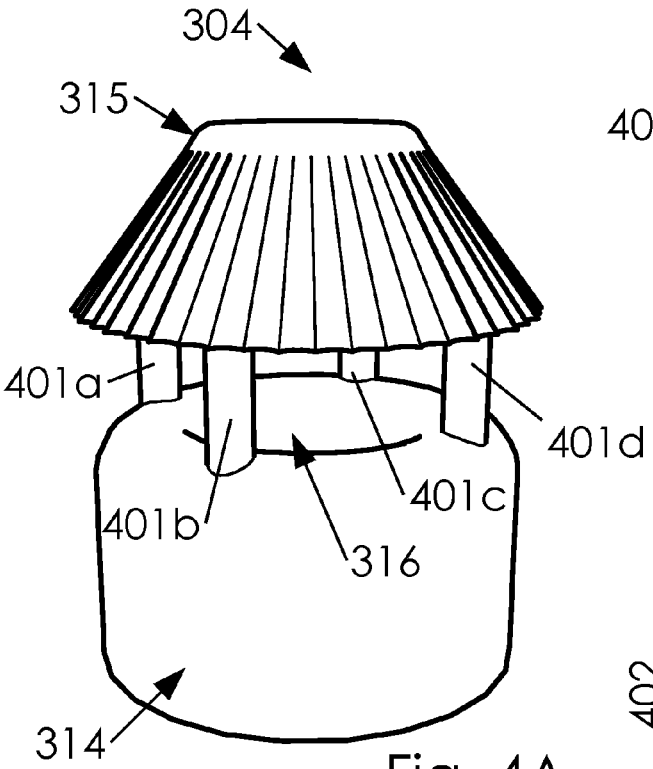
FIGS. 4A, 4B, 4C, 4D and 4E illustrate a perspective front view, a perspective front section cut view, an elevated top view, an elevated front view, and an elevated bottom view of floating vent, respectively.
Figure 4C:
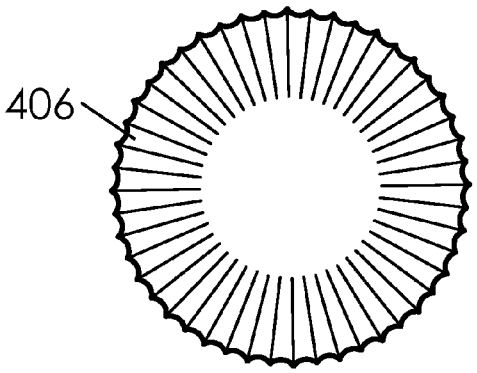
Figure 4D:
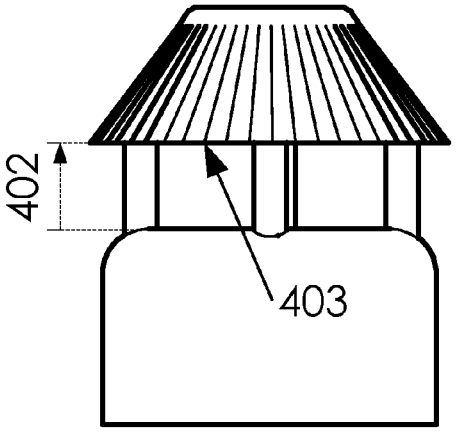
Figure 4B:
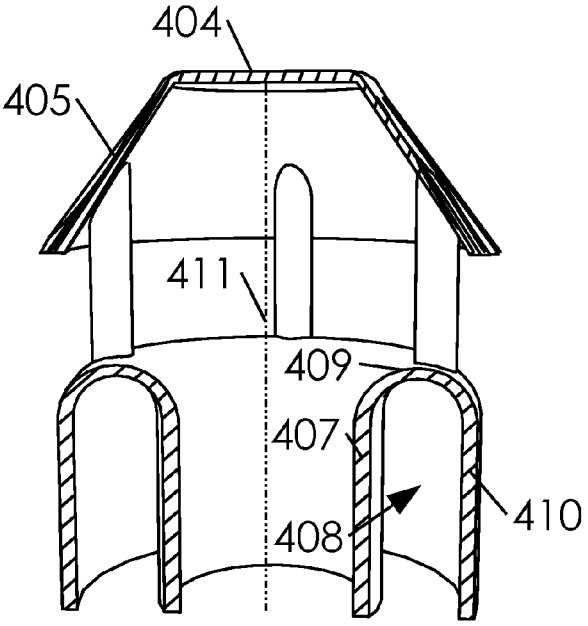
Figure 4E:
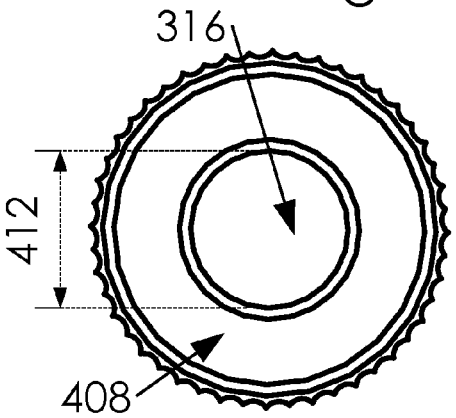

In one embodiment, lower portion 314 can comprise a substantially round member comprising vent 316 enclosed by an interior wall 407, a float chamber 408 enclosed by interior wall 407, a top portion 409 and an exterior wall 410. In one embodiment, as illustrated in FIG. 4B, lower portion 314 can comprise an inverted "U" shaped vertical cross-section; wherein, said "U" shape wraps around a center axis 411 having said interior wall 407 and exterior wall 410 as side portions and top portion 409 as a curved portion connecting said side portions together. In one embodiment, vent 316 can comprise a diameter 412.

Figures 5A, 5B, 5C:
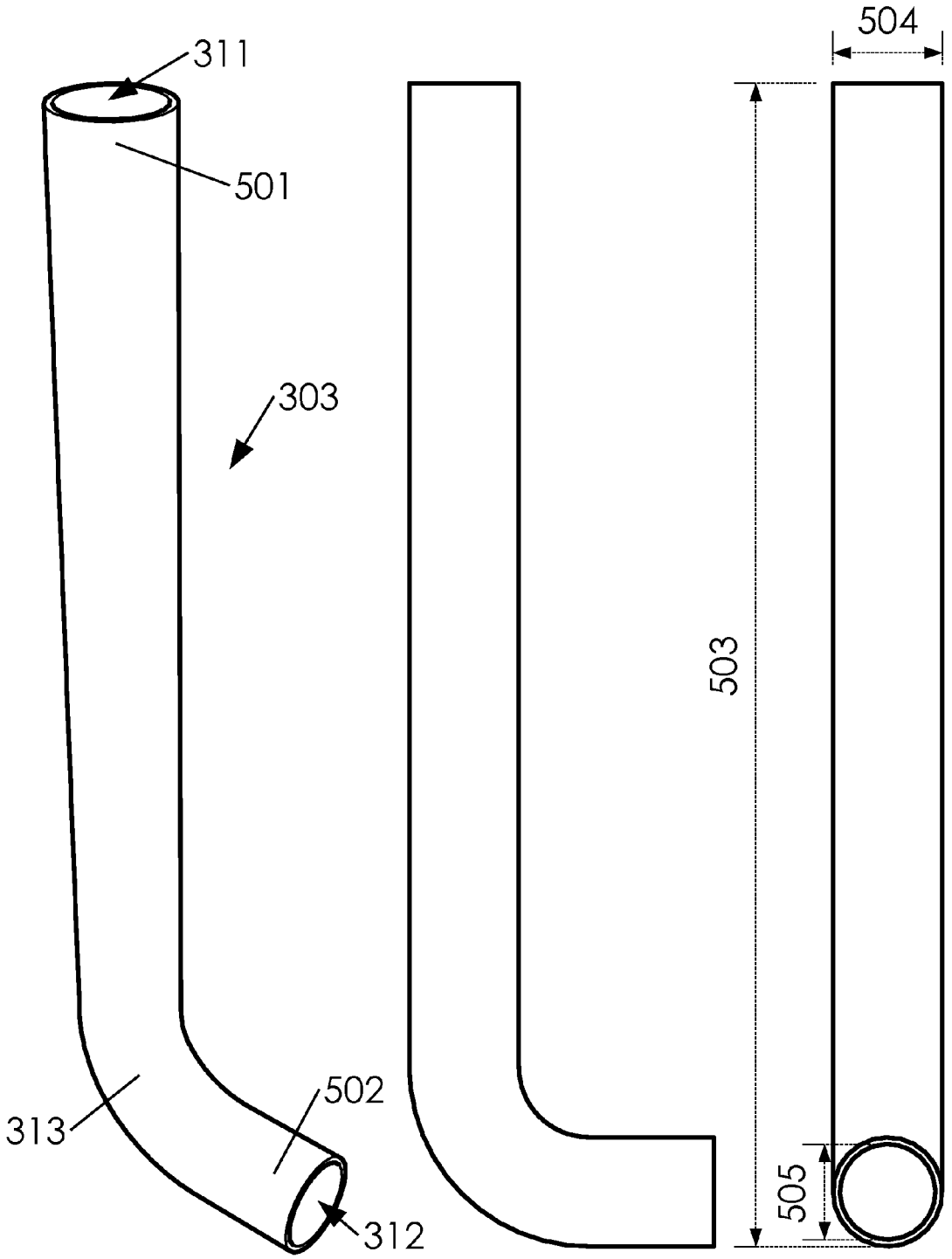
FIGS. 5A, 5B and 5C illustrate an elevated front view, an elevated side view, a perspective front view and an elevated cross-section front view of snorkel.
Figure 6A:
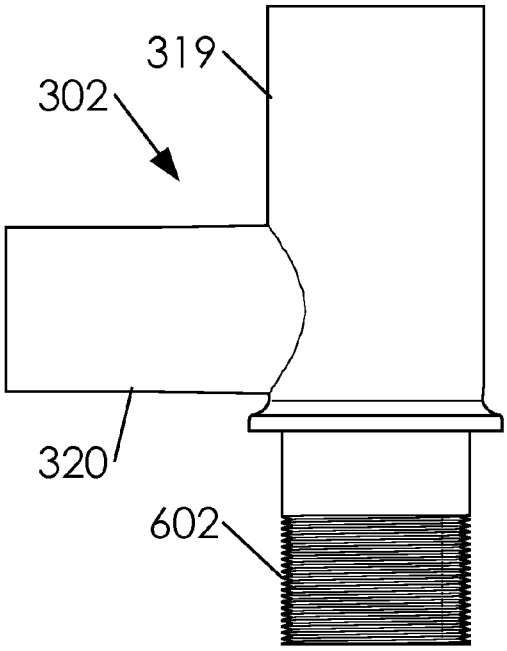
FIGS. 6A, 6B, 6C and 6D illustrate an elevated front view, an elevated side view, a perspective front overview and an elevated cross-section front view of second manifold.
Figure 6B:
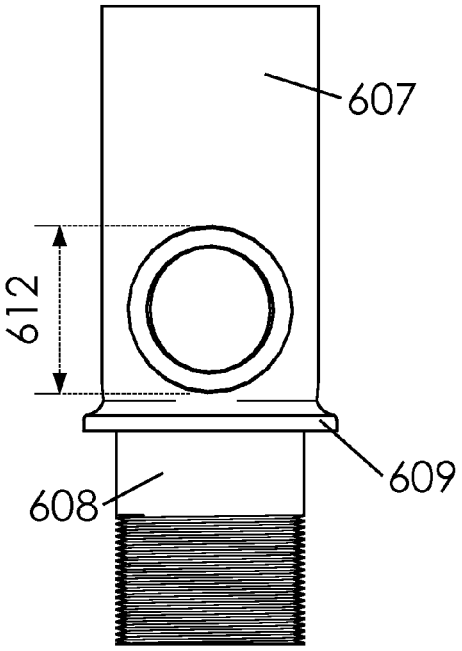
Figure 6C:
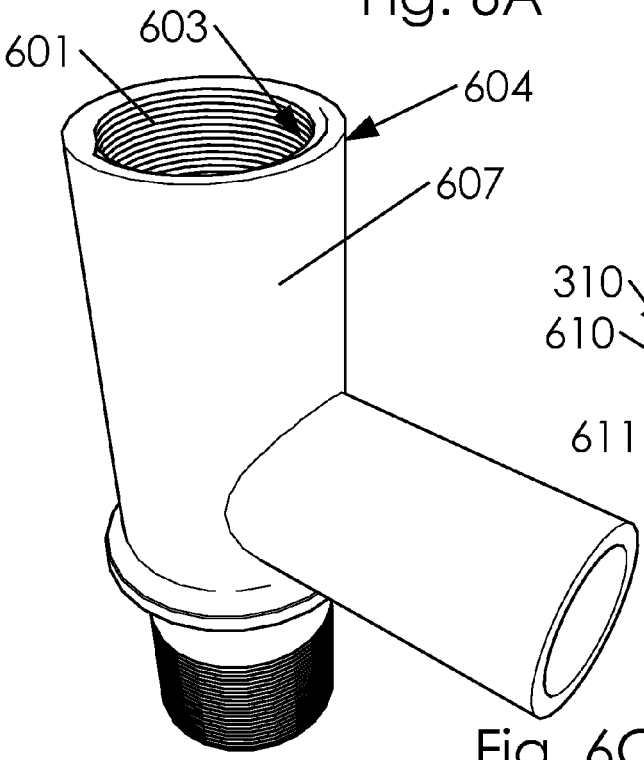
Figure 6D:
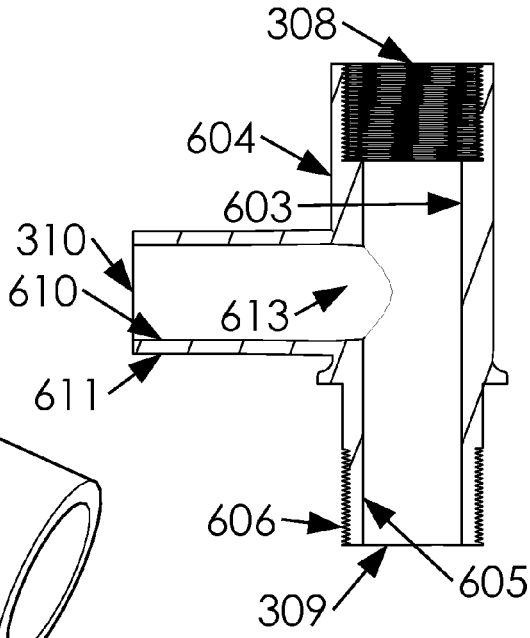
Figure 7A:
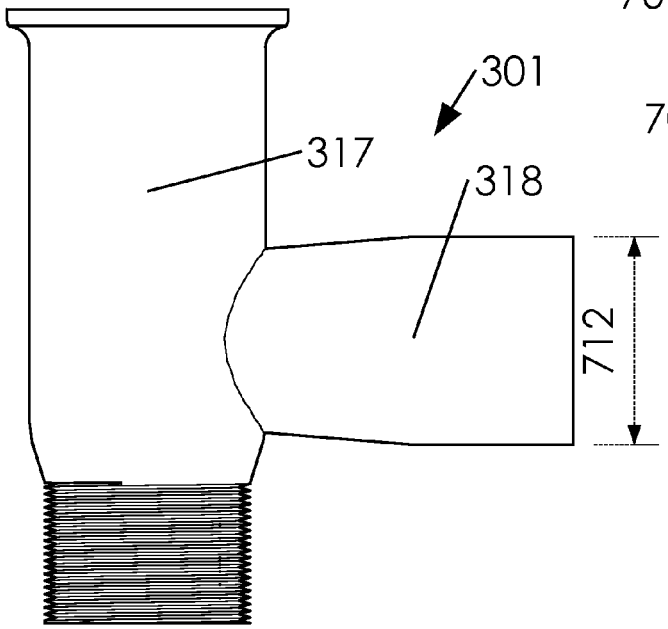
FIGS. 7A, 7B, 7C and 7D illustrate an elevated front view, an elevated side view, a perspective front overview and an elevated cross-section front view of first manifold.
Figure 7B:
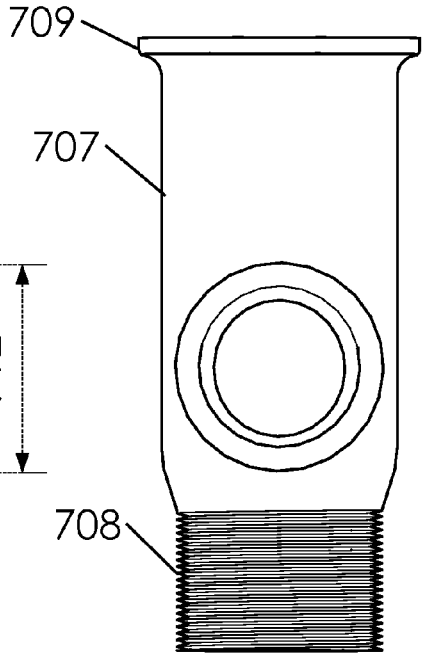
Figure 7C:
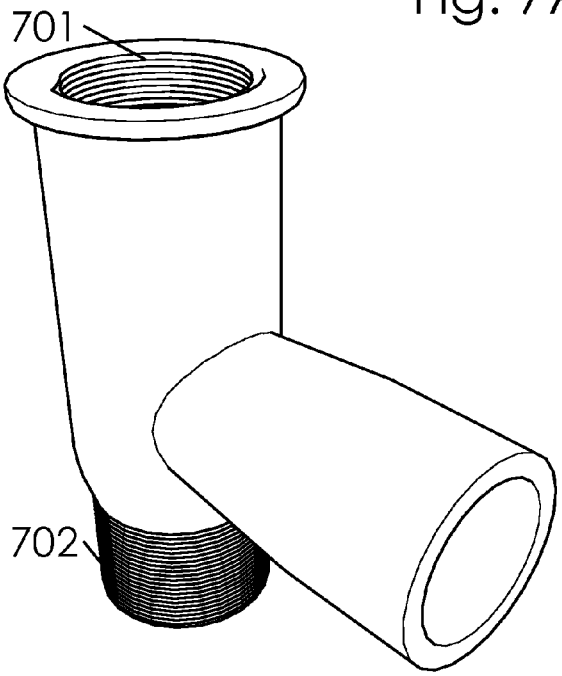
Figure 7D:
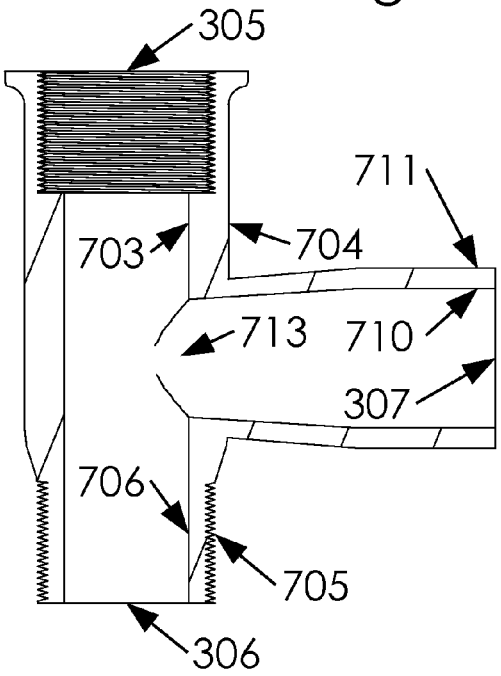

FIGS. 5A, 5B and 5C illustrate an elevated front view, an elevated side view, a perspective front view and an elevated cross-section front view of snorkel 303. In one embodiment, snorkel 303 can comprise a substantially hollow tube between first opening 311 and second opening 312. In one embodiment, snorkel 303 can comprise a first end 501 and a second end 502. In one embodiment, snorkel 303 can comprise a substantially round cross-section. In one embodiment, snorkel 303 can comprise an "L" shape; wherein, first end 501 can comprise a top end of said "L" shape, elbow 313 can comprise a bend in said "L" shape, and second end 502 can comprise a bottom end of said "L" shape. In one embodiment, first opening 311 can be at first end 501. In one embodiment, second opening 312 can be at said second end 502. In one embodiment, snorkel 303 can comprise a height 503 and a diameter 504. In one embodiment, diameter 504 can be less than or diameter 412. In one embodiment, second opening 312 can comprise an internal diameter 505.

FIGS. 6A, 6B, 6C and 6D illustrate an elevated front view, an elevated side view, a perspective front overview and an elevated cross-section front view of second manifold 302. In one embodiment, second manifold 302 can comprise a plurality of couplings for making fluid connection with one or more components of toilet vent 108 and tank components 200. For example, in one embodiment, second manifold 302 can comprise a socket 601, a base coupling 602, and a portion of side portion 320 for making such connections.

In one embodiment, socket 601 can be around first opening 308. Second manifold 302 can comprise an inner surface 603 and an outer surface 604 at first opening 308. Second manifold 302 can comprise an inner surface 605 and an outer surface 606 at second opening 309. In one embodiment, base coupling 602 can be around second opening 309. In one embodiment, socket 601 can comprise a female treading at inner surface 603. In one embodiment, base coupling 602 can comprise a male threading at inner surface 605. In one embodiment, vertical portion 319 can comprise an upper portion 607, a lower portion 608, and a lip 609.

Second manifold 302 can comprise an inner surface 610 and an outer surface 611 at third opening 310. In one embodiment, snorkel 303 can attach to second manifold 302 by connecting second opening 312 to third opening 310. In one embodiment, second opening 312 can attach to third opening 310 by sliding side portion 320 inside of second opening 312. In one embodiment, side portion 320 can comprise an external diameter 612. In one embodiment, external diameter 612 of side portion 320 of second manifold 302 can be substantially equal to internal diameter 505 of second opening 312 of snorkel 303. In one embodiment, side portion 320 can be held inside of second opening 312 by tension between snorkel 303 and second manifold 302. In another embodiment, side portion 320 can be held inside of second opening 312 by a threaded socket coupling. Other means of holding sockets together are well known in the art and are incorporated herein accordingly.

In one embodiment, side portion 320 can be in fluid connection with vertical portion 319 at a joint 613. In one embodiment, joint 613 can comprise an opening between vertical portion 319 and side portion 320.

FIGS. 7A, 7B, 7C and 7D illustrate an elevated front view, an elevated side view, a perspective front overview and an elevated cross-section front view of first manifold 301. In one embodiment, first manifold 301 can comprise a plurality of couplings for making fluid connection with one or more components of toilet vent 108 and tank components 200. For example, in one embodiment, first manifold 301 can comprise a socket 701, a base coupling 702, and a portion of side portion 318 for making such connections.

In one embodiment, socket 701 can be around first opening 305. First manifold 301 can comprise an inner surface 703 and an outer surface 704 at first opening 305. First manifold 301 can comprise an inner surface 705 and an outer surface 706 at second opening 306. In one embodiment, base coupling 702 can be around second opening 306. In one embodiment, socket 701 can comprise a female treading at inner surface 703. In one embodiment, base coupling 702 can comprise a male threading at inner surface 705. In one embodiment, vertical portion 317 can comprise an upper portion 707, a lower portion 708, and a lip 709.

First manifold 301 can comprise an inner surface 710 and an outer surface 711 at third opening 307. In one embodiment, snorkel 303 can attach to first manifold 301 by connecting second opening 312 to third opening 307.

In one embodiment, side portion 318 can be in fluid connection with vertical portion 317 at a joint 713. In one embodiment, joint 713 can comprise an opening between vertical portion 317 and side portion 318.

Figure 8A:
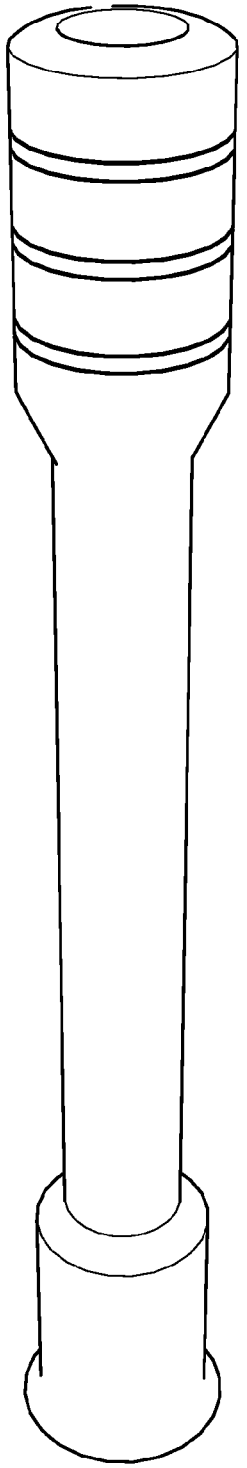
FIGS. 8A, 8B and 8C illustrate a perspective front overview, an elevated front view and an elevated wireframe front view of up rod.
Figure 8B:
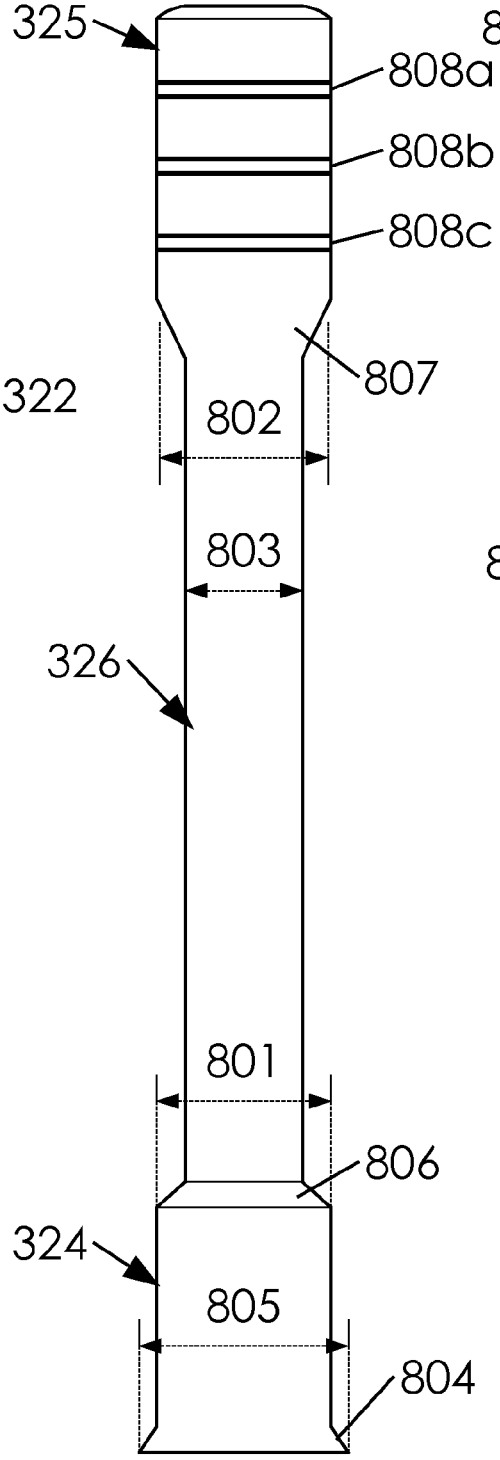
Figure 8C:
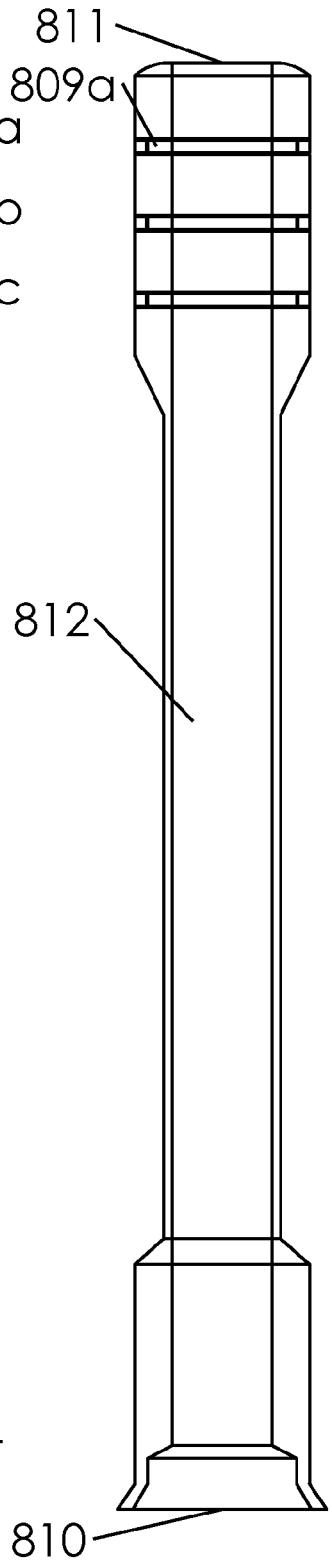

FIGS. 8A, 8B and 8C illustrate a perspective front overview, an elevated front view and an elevated wireframe front view of up rod 322. As discussed, up rod 322 can comprise first end 324, second end 325 and middle portion 326. First end 324 can comprise an external diameter 801. Second end 325 can comprise an external diameter 802. Middle portion 326 can comprise an external diameter 803. In one embodiment, external diameter 801 and external diameter 802 can be substantially equal. In one embodiment, external diameter external diameter 803 can be less than external diameter 802 and/or external diameter 801. First end 324 can comprise a lip 804 having a diameter 805. In one embodiment, diameter 805 can be greater than external diameter 801. In one embodiment, up rod 322 can taper down from external diameter 801 to external diameter 803 at a tapering portion 806. Likewise, up rod 322 can taper out from external diameter 803 to external diameter 802 at a second tapering portion 807.

Second end 325 can comprise a plurality of gaskets 808. In one embodiment, gaskets 808 can be held on second end 325 by sliding gaskets 808 into a plurality of gasket cuts 809. In one embodiment, gasket cuts 809 can each comprise a substantially horizontal cut in an external surface of second end 325 capable of holding gaskets 808. In one embodiment, gaskets 808 can comprise a first gasket 808*a*, a second gasket 808*b* and a third gasket 808*c*. In one embodiment, gasket cuts 809 can comprise a first cut 809*a*, a second cut 809*b* and a third cut 809*c*.

Up rod 322 can comprise a first opening 810, a second opening 811 and a fluid channel 812. In one embodiment, sanitary fluid 109 can travel through up rod 322 by entering first opening 810, travelling through fluid channel 812, and exiting at second opening 811.

Figure 9A:
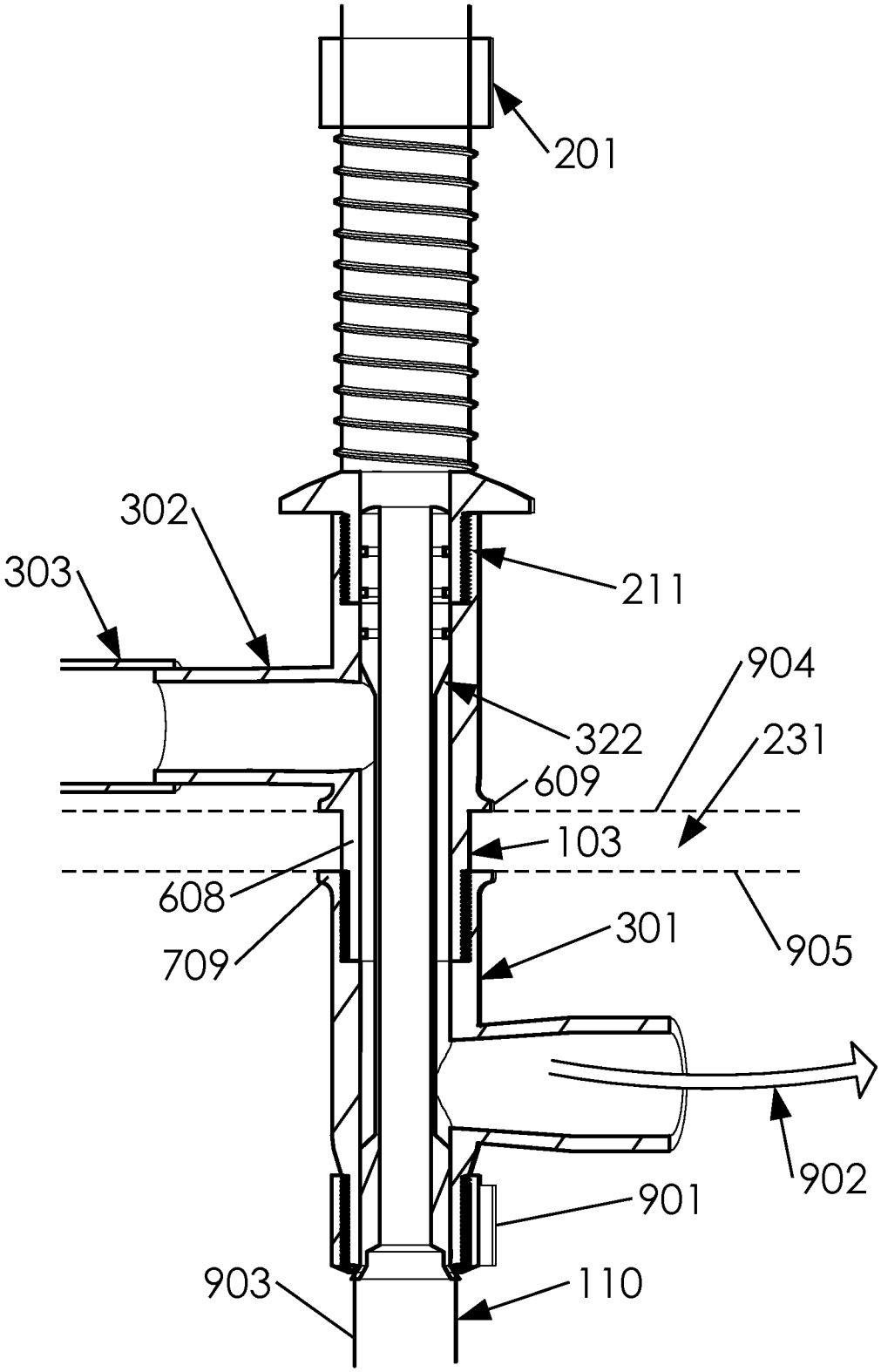
FIG. 9 illustrates an elevated cross-section front view of tank components and toilet vent in an assembled configuration.

FIG. 9 illustrates an elevated cross-section front view of tank components 200 and toilet vent 108 in an assembled configuration. In one embodiment, toilet vent 108 can be installed into tank 101 by: inserting second manifold 302 into tank 101; sliding a portion of second manifold 302 through fluid input 103; attaching second manifold 302 to first manifold 301; blocking fluid input 103 with a portion of first manifold 301 and second manifold 302; sliding up rod 322 through first manifold 301 and second manifold 302; attaching a line socket 901 of supply line 110 around a portion of up rod 322 and first manifold 301; attaching tank components 200 to second manifold 302; attaching snorkel 303 to second manifold 302; and attaching a vacuum source 902 to first manifold 301. In one embodiment, supply line 110 can comprise a hose portion 903 and line socket 901. In one embodiment, hose portion 903 can provide sanitary fluid 109 to toilet vent 108 and tank components 200. In one embodiment, line socket 901 can hold supply line 110 to toilet vent 108. In one embodiment, line socket 901 can freely rotate relative to hose portion 903 and attach to base coupling 702 or any similar threaded base coupling. In one embodiment, vacuum source 902 can comprise a fan attached to toilet vent 108 in a fluid connection.

In one embodiment, ballcock assembly 201 can connect to second manifold 302 by attaching coupling 211 to socket 601. In one embodiment, second manifold 302 can connect to first manifold 301 by attaching base coupling 602 to socket 701. In one embodiment, second manifold 302 can connect to snorkel 303 by sliding side portion 320 into second opening 312. As is common in the art, in one embodiment, each of said base couplings can attach to their respective sockets by rotating said base coupling relative to said sockets so as to lock the respective male threaded portions into the respective female portions.

In one embodiment, first manifold 301 can attach to second manifold 302 at bottom 231 through fluid input 103. Thus, in one embodiment, toilet vent 108 can be assembled in tank 101 without creating a new aperture in tank 101 or replacing an existing tank 101 provided fluid input 103 is available. In one embodiment, lower portion 608 can comprise a substantially smooth portion of outer surface 606 of vertical portion 319. In one embodiment, a portion of tank 101 (such as bottom 231) can be held between second manifold 302 and first manifold 301 by pressing lip 609 against an inner surface 904 of tank 101 and pressing lip 709 against an outer surface 905 of tank 101. Thus, in one embodiment, lower portion 608 can extend between inner surface 904 and outer surface 905, and lip 609 and lip 709 can hold a portion of tank 101 around fluid input 103.

Figure 10A:
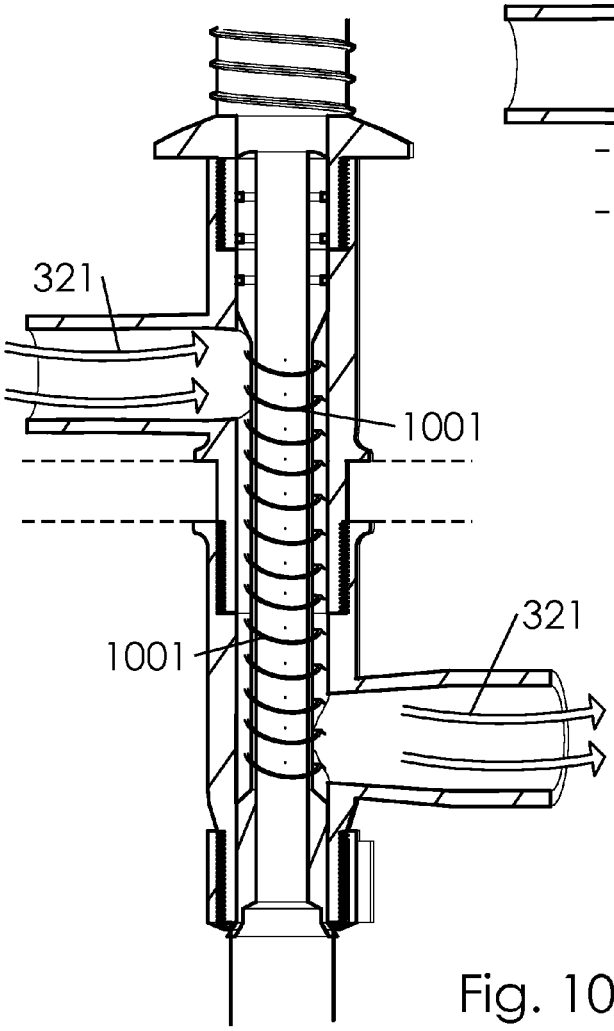
FIGS. 10A and 10B illustrate first fluid connection and second fluid connection with an elevated cross-section front view of toilet vent and tank components.
Figure 10B:
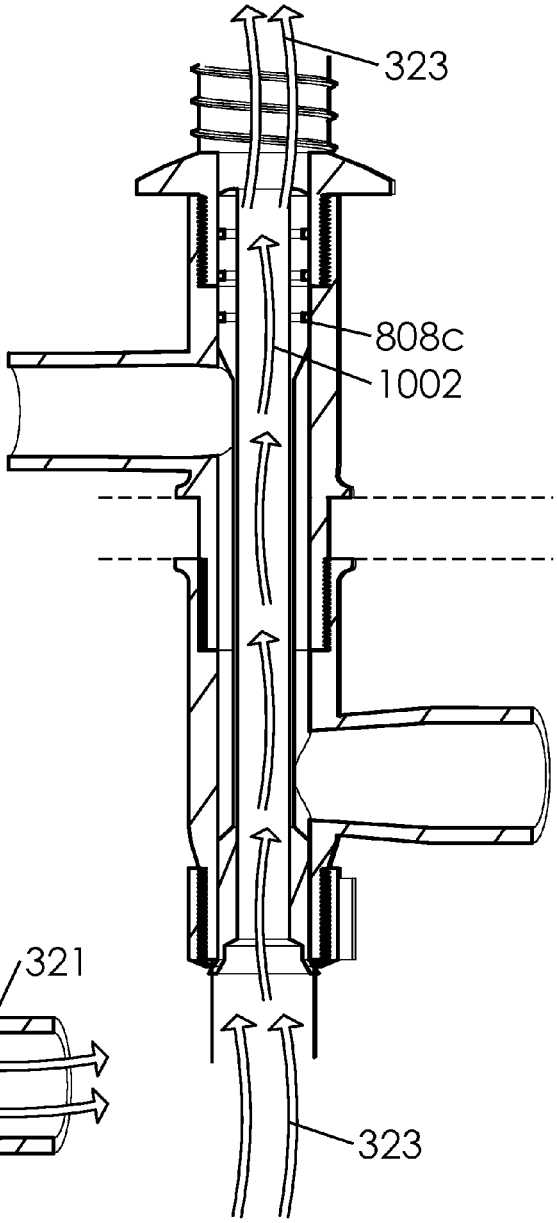

FIGS. 10A and 10B illustrate first fluid connection 321 and second fluid connection 323 with an elevated cross-section front view of toilet vent 108 and tank components 200.

In one embodiment, a portion of first fluid connection 321 between third opening 310 and third opening 307 can comprise an outbound fluid passage 1001. In one embodiment, outbound fluid passage 1001 can comprise a fluid passage around middle portion 326, between first end 324 and second end 325 of up rod 322, and inside of both vertical portion 319 and vertical portion 317. Thus, in one embodiment, up rod 322 can be inserted through, but not totally block, a passage inside of vertical portion 319 and vertical portion 317.

Outbound fluid passage 1001 is illustrated with circular arrows around middle portion 326 in FIG. 10A; however, a movement of gases 238 is not restricted to a circular path while in outbound fluid passage 1001.

In one embodiment, a portion of second fluid connection 323 between first end 324 and second end 325 of up rod 322 can comprise an inbound fluid passage 1002. In one embodiment, inbound fluid passage 1002 can travel through fluid channel 812 between first opening 810 and second opening 811.

In one embodiment, gases 238 and sanitary fluid 109 are kept from spilling between first fluid connection 321 and second fluid connection 323 by sealing first end 324 and second end 325 inside of first manifold 301 and second manifold 302. For example, in one embodiment, second end 325 can seal against inner surface 603 by pressing gaskets 808 against inner surface 603. Likewise, in one embodiment, first end 324 can seal against second opening 306 by pressing lip 804 against a portion of lower portion 708 between inner surface 705 and outer surface 706.

Thus, in one embodiment, said toilet vent system and method can facilitate first fluid connection 321 and second fluid connection 323 simultaneously.

Figure 11A:
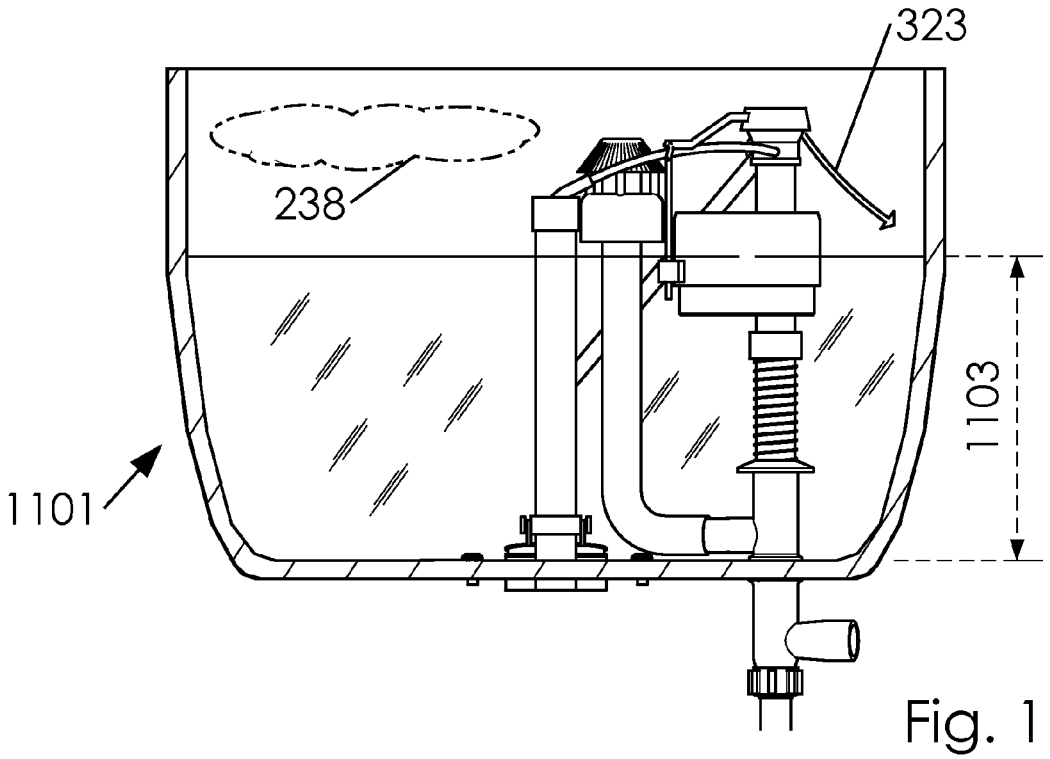
FIGS. 11A and 11B illustrate an unfilled configuration and filled configuration in an elevated cross-section front view of tank with tank components and toilet vent.
Figure 11B:
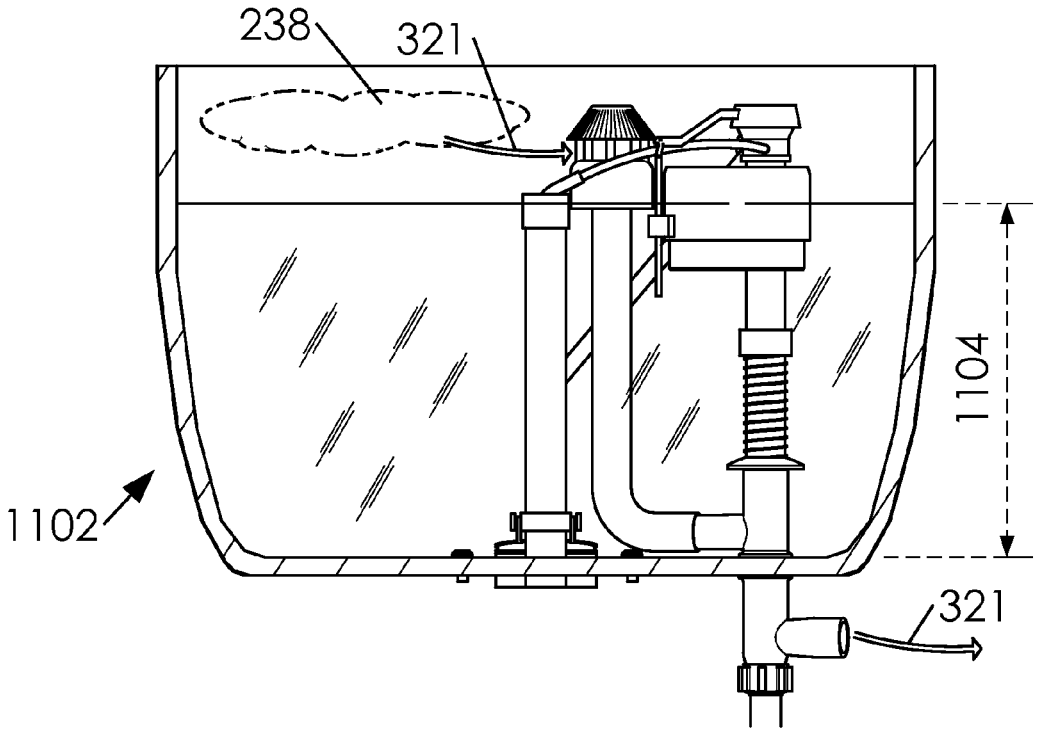

FIGS. 11A and 11B illustrate an unfilled configuration 1101 and filled configuration 1102 in an elevated cross-section front view of tank 101 with tank components 200 and toilet vent 108. As is well known in the art, toilet 100 can comprise an at-rest stage, a flushing stage, and a refilling stage. Further, said flushing stage and said refilling stage can be referred to together as a non-at-rest stage. Likewise, it is well known that while in said at-rest stage sanitary fluid 109 is typically not flowing between tank 101 and bowl 102. While in said flushing stage, sanitary fluid 109 is typically flowing between tank 101 and bowl 102. Finally while in said refilling stage, sanitary fluid 109 is flowing into tank 101 through fluid input 103 and ballcock assembly 201, or similar; wherein, sanitary fluid 109 is typically no longer flowing between tank 101 and bowl 102.

Unfilled configuration 1101 can comprise sanitary fluid 109 at one of a plurality of unfilled levels 1103. Filled configuration 1102 can comprise sanitary fluid 109 at a filled level 1104.

In one embodiment, toilet vent 108 can selectively regulate a removal of gases 238 from tank 101 as toilet 100 transitions between said at-rest state and said non-at-rest stages. For example, in one embodiment, first fluid connection 321 can comprise an open-configuration and a closed-configuration. In one embodiment, said closed-configuration can comprise a portion of said first fluid connection 321 blocked to prevent a fluid movement within first fluid connection 321. In one embodiment, said open-configuration can comprise first fluid connection 321 without a hindrance to said fluid movement within first fluid connection 321. In one embodiment, a portion of floating vent 304 can comprise said hindrance to said first fluid connection 321. In one embodiment, first fluid connection 321 can comprise said open-configuration when toilet 100 is in said at-rest stage. Thus, in one embodiment, gases 238 can flow through first fluid connection 321 in said open-configuration from vent 316 to third opening 307. Further, in one embodiment, vacuum source 902 can pull gases 238 through first fluid connection 321 when first fluid connection 321 is in said open-configuration. Likewise, in one embodiment, first fluid connection 321 can comprise said closed-configuration when toilet 100 is in said non-at-rest configurations. Thus, in one embodiment, neither gases 238 or sanitary fluid 109 can flow through first fluid connection 321 while toilet 100 is in said non-at-rest configurations.

Figure 12A:
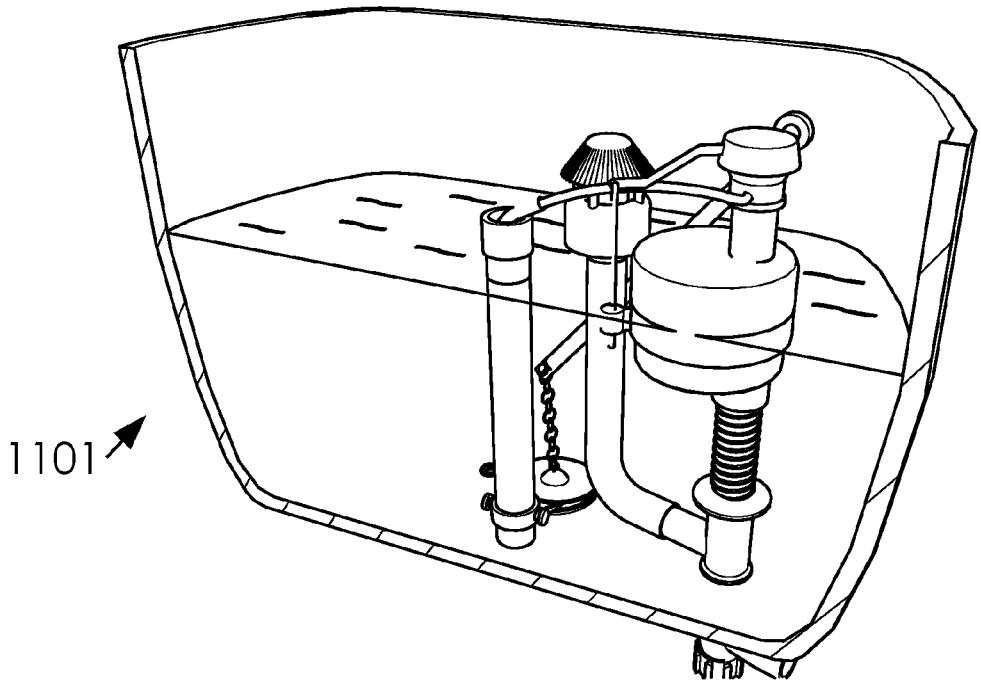
FIGS. 12A and 12B illustrate an unfilled configuration and filled configuration in a perspective cross-section front view of tank with tank components and toilet vent.
Figure 12B:
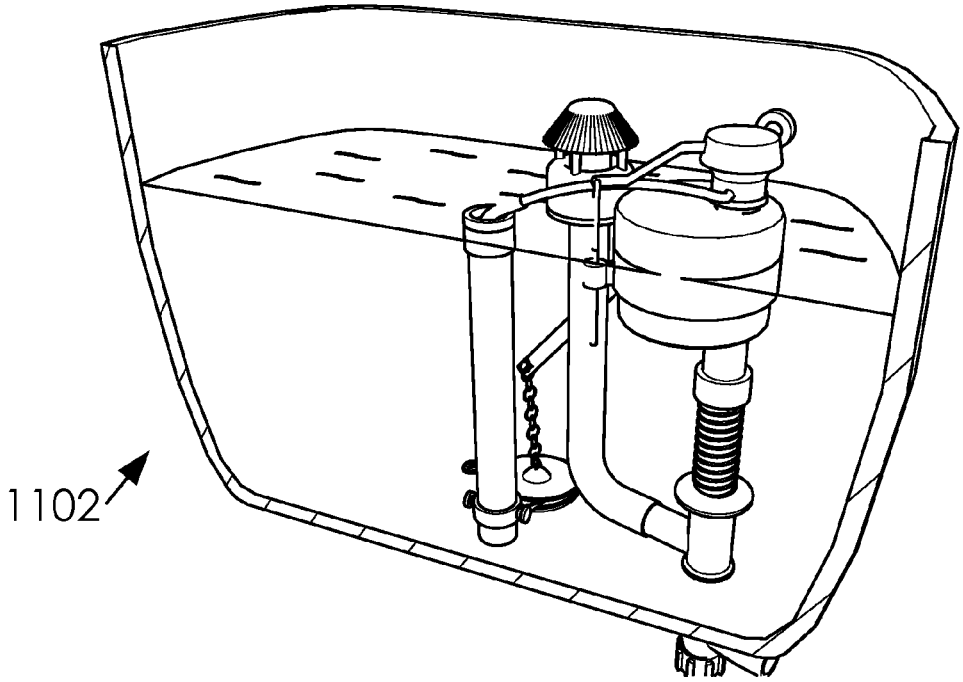

FIGS. 12A and 12B illustrate an unfilled configuration 1101 and filled configuration 1102 in a perspective cross-section front view of tank 101 with tank components 200 and toilet vent 108.

Figure 13A:
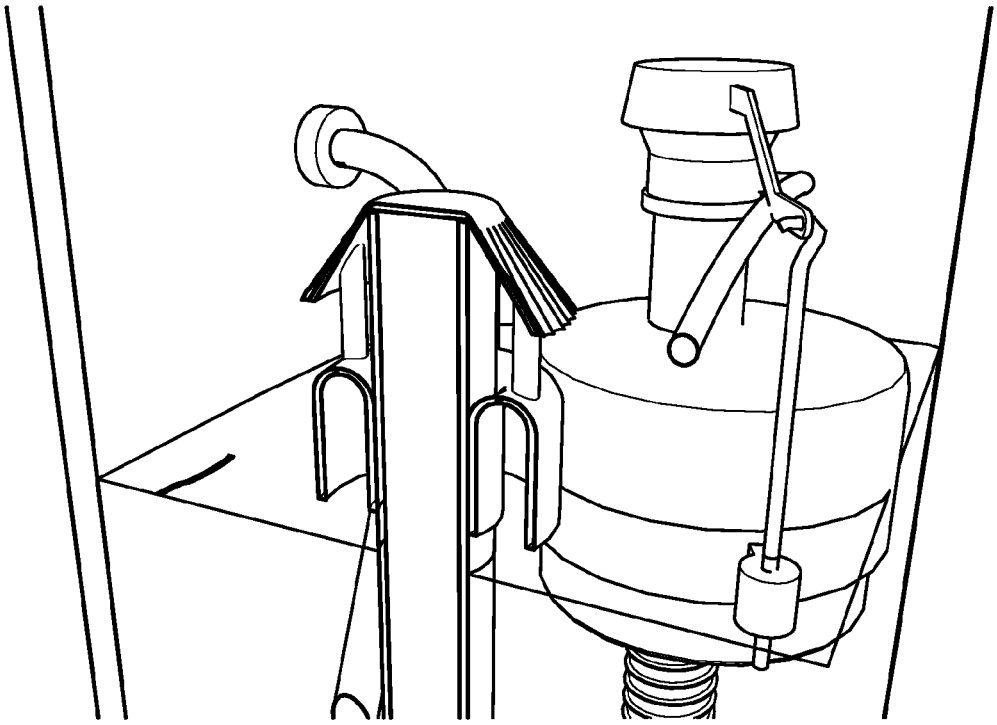
FIGS. 13A and 13B illustrate an unfilled configuration and filled configuration in a perspective cross-section side view of floating vent in tank.
Figure 13B:
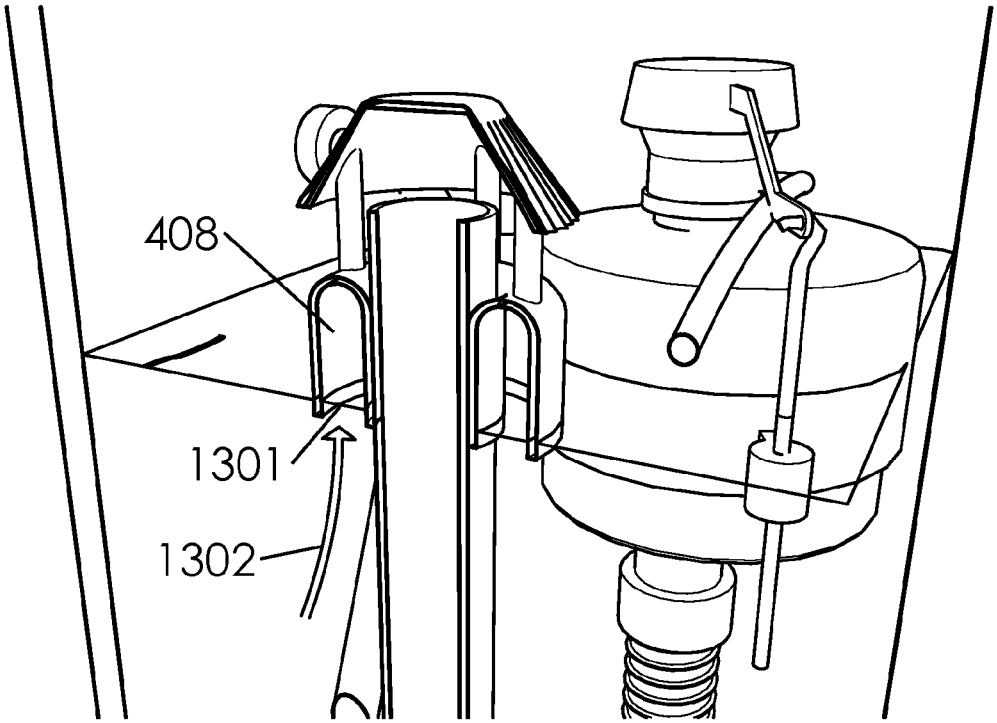

FIGS. 13A and 13B illustrate an unfilled configuration 1101 and filled configuration 1102 in a perspective cross-section side view of floating vent 304 in tank 101. In one embodiment, floating vent 304 can move to cause first fluid connection 321 to transition between said open-configuration and said closed-configuration. In one embodiment, sanitary fluid 109 can regulate whether upper portion 315 of floating vent 304 blocks first opening 311 of snorkel 303. For example, in one embodiment, filled level 1104 can comprise sanitary fluid 109 enclosing float chamber 408 along a bottom opening 1301 and thereby applying an upward force 1302 on floating vent 304 and, thus, open said vent 316 and first opening 311. Likewise, in one embodiment, unfilled levels 1103 can relieve said upward force 1302 and thereby allow floating vent 304 to fall and thereby close first fluid connection 321 by blocking first opening 311 with upper portion 315 of floating vent 304. That is, in one embodiment, a buoyant portion of floating vent 304 can apply upward force 1302 to floating vent 304 to open said first fluid connection 321 or to remove upward force 1302 to close said first fluid connection 321. In one embodiment, float chamber 408 can comprise said buoyant portion of floating vent 304.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A toilet vent comprising:

a first fluid connection between an upper portion of a tank of a toilet above a sanitary fluid level and a gas outlet outside of said tank; and, a second fluid connection between a supply line outside of said tank and one or more tank components inside of said tank; wherein, said toilet vent is capable of housing said first fluid connection and said second fluid connection; and, a portion of said toilet vent, containing a portion of both said first fluid connection and said second fluid connection, passes through a fluid input in a bottom of said tank.

2. The toilet vent of claim 1 wherein said first fluid connection is capable of transferring one or more gases between said tank and said gas outlet, and said second fluid connection is capable of transferring a supply of said sanitary fluid between a supply line and said tank.

3. The toilet vent of claim 2 wherein said gases comprise a foul odor.

4. The toilet vent of claim 2 wherein a portion of said sanitary fluid comprises water.

5. The toilet vent of claim 1 further comprising a first manifold, a second manifold and a up rod; wherein, said first fluid connection comprises an outbound fluid passage through said fluid input of said tank;

said second fluid connection comprises an inbound fluid passage through said fluid input of said tank;

said inbound fluid passage passes through said up rod and said outbound fluid passage passes through a portion of said first manifold and said second manifold;

a portion of said up rod can pass through a portion of said first manifold and said second manifold without Hocking said outbound fluid passage; and said outbound fluid passage and said inbound fluid passage are kept from mixing by sealing one or more portions of up rod within said first manifold and said second manifold.

6. The toilet vent of claim 1 further comprising:

a first manifold comprising a fluid passage between a first opening, a second opening, and a third opening;

a second manifold comprising a fluid passage between a first opening, a second opening, and a third opening;

a snorkel comprising a fluid passage between a first opening and a second opening;

a floating vent having a lower portion, a upper portion and a vent; and an up rod having a first opening and a second opening; wherein, said first fluid connection comprises a fluid passage between said vent and said third opening of said first manifold, and said second fluid connection comprises a fluid passage between said first opening and said second opening of said up rod.

7. The toilet vent of claim 6 wherein said first fluid connection comprises a fluid passage between:

said upper portion of said tank and said vent of said floating vent;

said vent of said floating vent and said first opening of said snorkel;

said first opening of said snorkel and said second opening of said snorkel;

second opening of said snorkel and said third opening of said second manifold;

said third opening and said second opening of said second manifold;

said second opening of said second manifold and said first opening of said first manifold; and said first opening and third opening of said first manifold.

8. The toilet vent of claim 7 wherein said first fluid connection can connect to said gas outlet capable of pulling one or more gases out of said upper portion through said first fluid connection.

9. The toilet vent of claim 8 wherein said first fluid connection provides said fluid passage from upper portion of tank above said sanitary fluid, down through said sanitary fluid in said tank and to said gas outlet outside of said fluid input of said tank.

10. The toilet vent of claim 8 wherein said gas outlet can comprise a ventilation system capable of applying a vacuum source to said first fluid connection.

11. The toilet vent of claim 8 wherein said gas outlet can comprise fan assembly capable of applying a vacuum source to said first fluid connection.

12. The toilet vent of claim 6 wherein said first manifold and said second manifold each comprise a "T" shape; wherein, each of said first manifold and said second manifold comprise a vertical portion and a side portion;

said "T" shape is rotated such that said vertical portions comprise a top portion of said "T" shape oriented in a vertical direction and said side portions extend in a horizontal direction from a midpoint of said vertical portions;

said vertical portion of said first manifold comprises said first opening at a first end and said second opening at a second end;

said side portion of said first manifold comprises said third opening at a first end and a joint with said vertical portion at a second end;

said vertical portion of said second manifold comprise said first opening at a first end and said second opening at a second end; and, said side portion of said second manifold comprises said third opening at a first end and a joint with said vertical portion at a second end.

13. The toilet vent of claim 6 wherein said up rod comprises a first end, a second end and a middle portion; wherein, an external diameter of said middle portion is smaller than an external diameter of said first end and said second end; and, said second fluid connection runs through a fluid channel within said up rod without leaking into first fluid connection by sliding said up rod through a portion of said first manifold and said second manifold, sealing said first end and said second end of said up rod inside of said first manifold and said second manifold, allowing said first fluid connection to flow around a portion of said up rod, and allowing said second fluid connection to flow through said fluid channel within said up rod between said first opening and said second opening of said up rod.

14. The toilet vent of claim 13 said sealing said first end and said second end of up rod inside of said first manifold and said second manifold comprises:

pressing a lip at said first opening of said up rod against said second opening of said first manifold, and pressing one or more gaskets between said second end of said up rod and an inner surface of a vertical portion of said second manifold; wherein said lip comprise a diameter greater than said external diameter of said first end of said up rod, and said gaskets are attached around an external surface of said second end of said up rod.

15. The toilet vent of claim 14 said pressing said lip against said second opening of said first manifold comprises securing a line socket of said supply line around said lip and a base coupling of said first manifold, and receiving said sanitary fluid from said supply line into said up rod while blocking said second opening of said first manifold with said lip.

16. The toilet vent of claim 15 wherein, said line socket comprises a female threading, said base coupling of said first manifold comprises a male threading, and said line socket selectively secures around said base coupling of said first manifold by locking said male threading into said female threading by rotating said line socket relative to said base coupling.

17. The toilet vent of claim 6 wherein, said snorkel further comprises a first end, a second end and an elbow;

said snorkel comprises a hollow tube between said first opening and said second opening; and, said snorkel comprises an "L" shape, wherein said first end of said snorkel comprises a top end of said "L" shape, said second end of said snorkel comprises a bottom end of said "L" shape, and said elbow of said snorkel comprises a bend of said "L" shape.

18. The toilet vent of claim 6 further comprises installing said toilet vent into said toilet by:

inserting said second manifold into said tank, sliding a portion of said second manifold through said fink input of said tank, attaching said second manifold to said first manifold, blocking said fluid input of said tank with a portion of said first manifold and said second manifold, sliding said up rod through said first manifold and said second manifold, attaching a line socket of said supply line around a portion of said up rod and said first manifold, attaching said tank components to said second manifold, and attaching said snorkel to said second manifold.

19. The toilet vent of claim 18 wherein attaching one or more portions of said toilet vent to one another and to said tank components comprises:

attaching one or more sockets having a female threading to one or more base couplings having a male threading by screwing said base couplings into said sockets.

20. The toilet vent of claim 18 wherein:

said vertical portion of said first manifold comprises a upper portion, a lower portion and a lip; and said vertical portion of said second manifold comprises a upper portion, a lower portion and a lip; further wherein, said sliding a portion of said second manifold through said fluid input of said tank comprises inserting said lower portion of said second manifold into said fluid input, pressing said lip of said second manifold against an inner surface of said tank, attaching said upper portion of said first manifold to said lower portion of said second manifold, pressing said lip of said first manifold against an outer surface of said tank, and blocking said fluid input with said lower portion and said lip of said second manifold and said lip of said first manifold.

21. The toilet vent of claim 18 wherein:

said first opening of said first manifold comprises a socket, said second opening of said first manifold comprises a base coupling, said first opening of said second manifold comprises a socket, and said second opening of said second manifold comprises a base coupling; further wherein, attaching said second manifold to said first manifold comprise attaching said base coupling of said second manifold to said socket of said first manifold.

22. The toilet vent of claim 21 wherein:

said tank components comprise a ballcock assembly having a base coupling; further wherein, attaching said tank components to said second manifold comprises attaching said base coupling of said ballcock assembly to said socket of said second manifold.

23. The toilet vent of claim 18 wherein:

said second manifold comprises a side portion;

said side portion of said second manifold comprises a external diameter, and said second end of said snorkel comprises a internal diameter; further wherein attaching said snorkel to said second manifold comprises sliding and holding a portion of said side portion inside of said second opening of said snorkel.

24. The toilet vent of claim 1 wherein:

said first fluid connection comprises an open-configuration and a closed-configuration; further wherein, said toilet vent is capable of selectively transitioning between said open-configuration and said closed-configuration, said closed-configuration comprises a portion of said first fluid connection blocked to prevent a fluid movement, and said open-configuration comprises said first fluid connection without a hindrance to said fluid movement.

25. The toilet vent of claim 24 wherein:

said sanitary fluid within said tank comprises an at-rest stage and a plurality of non-at-rest stages;

said at-rest stage comprises a fluid level of said sanitary fluid at a filled level between a flushing stage and a refilling stage;

said non-at-rest stages comprise said fluid level at a plurality of unfilled levels while toilet is in said flushing stage and refilling stage; and said toilet vent is capable of selectively transitioning between said open-configuration and said closed-configuration by:

closing said vent of said floating vent while said fluid level is at one of said unfilled levels and opening said vent of said floating vent while said fluid level is at said filled level.

26. The toilet vent of claim 25 wherein:

opening said vent of said floating vent while said fluid level is at said filled level comprises:

floating a buoyant portion of said floating vent on said sanitary fluid, to create an upward force holding said vent open when said fluid level comprises said filled level.

27. The toilet vent of claim 26 wherein:

said buoyant portion of said floating vent comprises a float chamber in said lower portion of said floating vent;

said float chamber comprises an inverted "U" shape wrapping around a center axis of said floating vent having an interior wall, an exterior wall and a top portion connection said interior wall and exterior wall; and said float chamber comprises buoyancy on said sanitary fluid when said fluid level encloses a bottom opening of said float chamber and thereby traps a portion of said gases within said float chamber; further wherein, as said fluid level rises, said float chamber floats thereupon.

28. The toilet vent of claim 25 wherein, closing said vent of said floating vent while said level is at one of said unfilled levels comprises:

removing an upward force acting a buoyant portion of said floating vent by dropping said fluid level from below said floating vent and allowing said floating vent to close and block said first opening of said snorkel.

* * * * *